United States Patent [19]

Gagnon, Sr.

[11] Patent Number: 5,014,677

[45] Date of Patent: May 14, 1991

[54] PROTECTIVE DEVICE FOR TARGET THROWING APPARATUS

[75] Inventor: Kenneth M. Gagnon, Sr., Cumberland, R.I.

[73] Assignee: Quack Sporting Clays, Inc., Cumberland, R.I.

[21] Appl. No.: 466,778

[22] Filed: Jan. 18, 1990

[51] Int. Cl.[5] ..... F41B 3/04

[52] U.S. Cl. ..... 124/6; 129/1; 129/4; 129/8; 129/42; 70/178; 220/324

[58] Field of Search ..... 124/1, 4, 6, 7, 8, 42, 124/46, 47; 220/315, 324; 70/178

[56] References Cited

U.S. PATENT DOCUMENTS

| | | | |
|---|---|---|---|
| 540,318 | 6/1895 | Jenkins | 124/6 X |
| 622,924 | 4/1899 | Jenkins | 124/6 |
| 762,353 | 6/1904 | Schulte | 124/43 X |
| 792,824 | 6/1905 | Hardy | 124/8 |
| 1,690,461 | 11/1928 | Sieben | 70/178 X |
| 1,947,081 | 2/1934 | Grady et al. | 70/178 |
| 2,377,036 | 5/1945 | Quarfoot | 70/178 |
| 2,794,664 | 6/1957 | Kruger | 220/334 X |
| 2,812,102 | 11/1957 | Caplinger | 220/324 |
| 3,244,132 | 4/1966 | Leichner et al. | 124/8 |
| 3,322,108 | 5/1967 | Hoag | 124/8 |
| 4,014,310 | 3/1977 | Laporte et al. | 124/6 |
| 4,898,009 | 2/1990 | Lakoski et al. | 70/58 |

OTHER PUBLICATIONS

Remington Arms Co., Inc., "Skeet and Trap Equipment", Dec. 14, 1937, p. 52.

*Primary Examiner*—Peter M. Cuomo
*Assistant Examiner*—Carol I. Bordas
*Attorney, Agent, or Firm*—Barlow & Barlow, Ltd.

[57] ABSTRACT

A target throwing apparatus mount is provided with a support post and a lateral member on which a seat may be mounted. For security of the apparatus a housing fits over the apparatus and has a bar that engages the post and an eye that engages a mooring eye on the lateral member. The arrangement pulls the housing into the support post and when the eyes are locked together, the housing may not be removed.

5 Claims, 2 Drawing Sheets

PROTECTIVE DEVICE FOR TARGET THROWING APPARATUS

BACKGROUND OF THE INVENTION

Target traps that launch clay pigeons are generally mounted on some form of a stand and are placed out in open field areas from which location one may shoot at the clay targets as they are launched. Target traps are relatively bulky pieces of apparatus and it is inconvenient to place a number of them out in the field and then, at the end of the day when the shooting is over, remove them into an enclosure so that they cannot be damaged from pilferage or just plain vandalism. There has accordingly been a problem in the sporting field to secure the traps and it is therefore one of the principal objects of the present invention to provide a anti-vandalism device for a target trap.

SUMMARY OF THE INVENTION

A target trap apparatus is mounted on a support post that is fixedly secured to the ground as by having the same affixed to an anchor post cast into concrete or the like. The trap launcher is then fastened on the top of the support post for rocking movement relative thereto so that the same can be rocked into a substantial vertical position to take up less room. To operate the trap, a lateral member extends from the support post and preferably has mounted thereon a seat for the operator. A protective housing which has at least five walls fixed together is adapted to be placed over the trap launching device and the post. To secure the housing in place, one of the walls has a bar extending inwardly therefrom while the post has a bar extending outwardly therefrom in order to be engaged therewith. Opposite the wall containing the bar will be a mooring means in the form of a protruding eye that will mate with an eye on the lateral member. The distance between the post and the mooring eye is such that the wall containing the bar is maintained snug against the support post by the locked eyes. Securing means in the form of a padlock can then hold the protected cover in place and to impede one from utilizing bolt cutters on the padlock, suitable covering is welded to the lateral member over the eye.

DESCRIPTION OF THE PREFERRED EMBODIMENT

Figure 1:
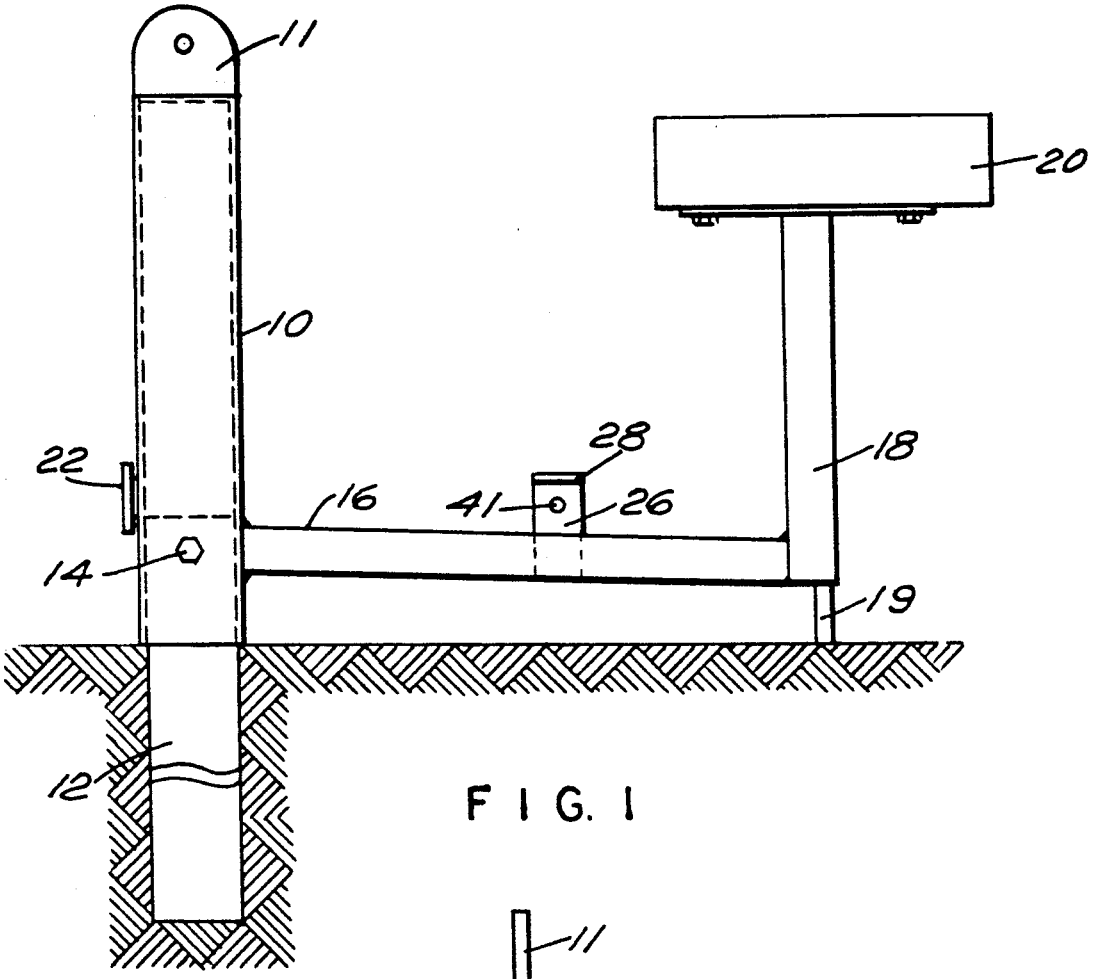
FIG. 1 is a side elevational view, partly in section, illustrating the target trap support means showing the manner in which the post is secured in the ground.
Figure 2:
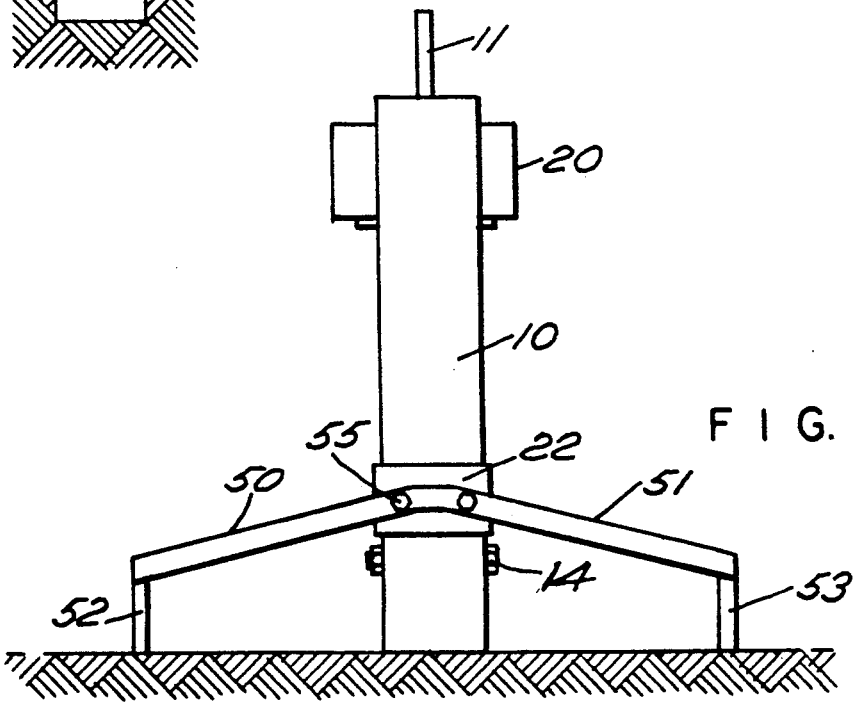
FIG. 2 is a front elevational view illustrating the use of the target throwing apparatus support post adapted for non-anchoring field use.
Figure 5:
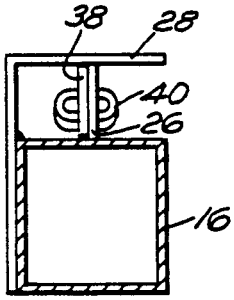
FIG. 5 is a view taken on lines 5—5 of FIG. 3.
Figure 4:
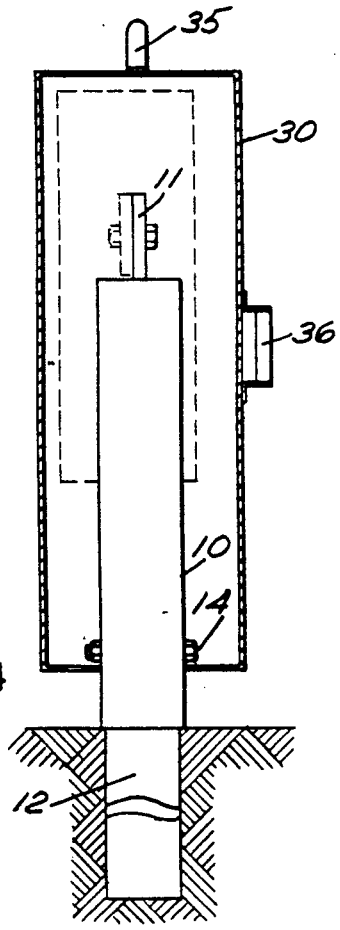
FIG. 4 is a front elevational view thereof.

Referring initially to FIG. 1, there is illustrated a trap support apparatus which consists essentially of a tubular support post 10 which is received onto an anchored solid post 12 which latter post is solidly received in the ground, preferably in concrete. The upper end of the anchor post 12 provided with a bore therein and the tubular support post 10 has one or more apertures therethrough to align with the anchor post bore so that an anchor bolt 14 may secure the tubular support post 10 to the anchor post 12. The apertures in the support post 10 at various positions permit the support post to be rotated to desirable launching positions. Secured to the support post 10 by being welded thereto is a lateral member 16 which has, at its extreme end, a vertical post 18 to which a seat 20 is secured. Extending downwardly from the member 18 is a leg 19. The upper end of the tubular support post 10 provided with a securing means which is illustrated in the form of an enlarged eye 11, and to this will be fitted by a bolt, a trap throwing device such as is illustrated in the Schulte patent, U.S. Pat. No. 762,353. The arrangement is such that the trap mechanism can be rocked for angular elevation on the eye to attain a proper launching position which is customary in the clay target field. Also, welded onto the post 10 in slight spaced relationship to the post is a plate 22 and welded to the lateral member 16 is a mooring eye 26 which has a protective angle bar 28 lying thereover. The angle bar at 28, which is seen more particularly in FIG. 5, is welded to the lateral member 16 and to the top of the mooring eye 26 so that a rigid structure is provided that is difficult to dislodge.

Figure 3:
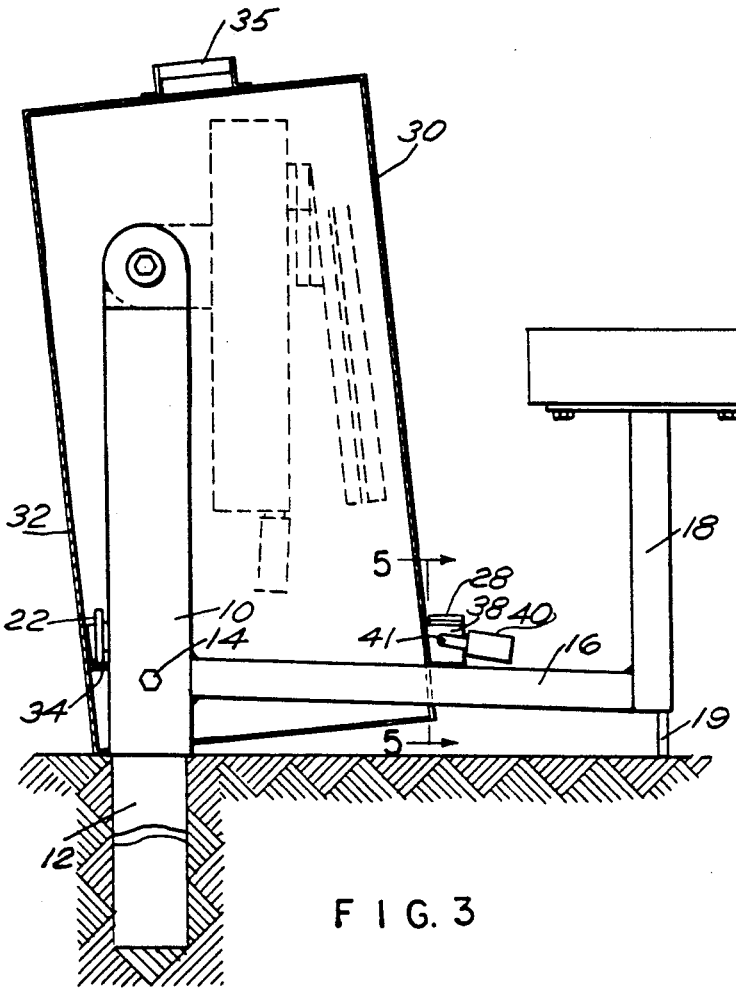
FIG. 3 is a side elevational view, partly in section, illustrating the protective cover enclosure for the trap in its operative position.

Referring now to FIG. 3 of the drawings, the protective cover 30 for the trap is illustrated, which protective cover is composed of five sides, there being four sides and a top wall. On one of the side walls 32 there is welded an angle bar 34 on the inner side thereof, which angle bar is at a location so that when the protective cover is resting on the ground and is pulled toward the support post, the angle bar will engage the lower edge of the space plate 22.

The protective cover is ideally provided with handles such as 35, 36 so that it may be lifted into place and as will be seen in phantom, the target trap has been angled downwardly somewhat in line with the support post 10 so that it is now in a position where the protective cover can be ideally placed thereover and the protective cover is provided with its eye 38 which engages the mooring eye 26 so that a padlock 40 may be passed through mating apertures 41 to secure the protective cover in place. It will be noted particularly by viewing FIG. 3 that the eye on the protective cover is at a location to pull the opposite wall in tightly against the support post and the arrangement is such that the angle bar 34 will prevent the lifting of the cover when it is in this particular position.

Ideally, the support means for the target trap is made in such a way that it can be used as a complete portable device and to this end, there is provided on the plate 22 a pair of tapped apertures. A leg structure consisting of a pair of angled legs 50, 51 and feet 52, 53 may be secured by a pair of bolts 55 to the plate 22 so that the support post 10 and its lateral member 16 can be taken to any location as desired and used as a portable support for a trap. It will be appreciated that the support post 10 is completely free of the ground anchor 12 in the portable mode.

I claim:

1. In a target throwing apparatus, a support post secured to the ground, a trap launcher fixed for rocking movement to the post, a lateral member extending from said post, a housing being a protective cover having a plurality of side and top walls fixed together enclosing the trap launcher, one wall having means engaging securance means on the post, the wall opposite said one wall having a mooring means to secure the wall to the lateral member.

2. In a target throwing apparatus as in claim 1 wherein the securance means comprises a bar spaced from the post and extending laterally of the post and the engaging means comprises an angle bar on the inner face of said one wall of the house that engages the post bar and is held in engaging position by said mooring means.

3. In a target throwing apparatus as in claim 1 wherein the mooring means comprises an eye protruding from said opposite wall and the lateral member has a complementary eye.

4. In a target throwing apparatus as in claim 1 wherein an anchor post is embedded in concrete and the support post is secured thereto.

5. In a target throwing apparatus as in claim 1 wherein the support post is provided with fastening means and legs are provided for attachment to the post to permit the apparatus to be made portable.

* * * * *